US005638716A

United States Patent [19]

Jonen

[11] Patent Number: 5,638,716

[45] Date of Patent: Jun. 17, 1997

[54] BENDING BLOCK FOR BENDING THE ROLLS OF CLUSTER ROLL STANDS

[75] Inventor: Peter Jonen, Duisburg, Germany

[73] Assignee: SMS Schloemann-Siemag Aktiengesellschaft, Düsseldorf, Germany

[21] Appl. No.: 237,347

[22] Filed: May 3, 1994

[30] Foreign Application Priority Data

May 3, 1993 [DE] Germany ..... 43 14 472.1

[51] Int. Cl.[6] ..... B21B 31/32

[52] U.S. Cl. ..... 72/241.8; 72/245

[58] Field of Search ..... 72/241.8, 245, 72/241.4, 246

[56] References Cited

U.S. PATENT DOCUMENTS

| | | | |
|---|---|---|---|
| 4,803,865 | 2/1989 | Jansen | 72/245 |
| 4,907,439 | 3/1990 | Diel et al. | 72/245 |
| 4,967,582 | 11/1990 | Bohnenkamp | 72/245 |
| 5,090,228 | 2/1992 | Schmiedberg et al. | 72/245 |

FOREIGN PATENT DOCUMENTS

| | | | |
|---|---|---|---|
| 58-168407 | 10/1983 | Japan | 72/241.8 |

*Primary Examiner*—John Sipos
*Assistant Examiner*—Thomas C. Schoeffler
*Attorney, Agent, or Firm*—Friedrich Kueffner

[57] ABSTRACT

A bending block for bending the rolls of cluster roll stands is rigidly connected on both sides of the chocks of the pair of rolls to be bent to the windowed housing posts of the roll housing or to units for the horizontal stabilization of the rolls. The bending block has bending jaws which are slidably guided in both bending directions and are driven by means of piston-cylinder units. The chocks or the units for horizontal stabilization have pressure receiving surfaces and the bending jaws have pressure contact surfaces which act on the pressure receiving surfaces in one or the other bending direction. Each bending jaw includes a pair of partial bending jaws which can be moved independently of each other and in opposite directions, wherein the pressure contact surfaces of each partial bending jaw corresponds to one or the other bending direction.

3 Claims, 3 Drawing Sheets

BENDING BLOCK FOR BENDING THE ROLLS OF CLUSTER ROLL STANDS

BACKGROUND OF THE INVENTION

1. Field of the Invention

The present invention relates to a bending block for bending the rolls of cluster roll stands. The bending block is rigidly connected on both sides of the chocks of the pair of rolls to be bent to the windowed housing posts of the roll housing or to units for the horizontal stabilization of the rolls. The bending block has bending jaws which are slidably guided in both bending directions and are driven by means of piston-cylinder units. The chocks or the units for horizontal stabilization have pressure receiving surfaces and the bending jaws have pressure contact surfaces which act on the pressure receiving surfaces in one or the other bending direction.

2. Description of the Related Art

In known embodiments of the bending blocks of cluster roll stands with pairs of work rolls and back-up rolls acting on the work rolls, the bending blocks are guided vertically and have horizontal slots with a rectangular cross section which can be slid onto correspondingly shaped, rectangular stop projections provided on the chocks of the work rolls. When the piston-cylinder units driving the bending blocks are actuated, bending forces are applied on the chocks, so that a bending movement is imparted on the chocks and the chocks are moved either toward each other or away from each other. During the rolling operation, the bending jaws for the upper and the lower chocks together follow the vertical movements of the work rolls produced in the work rolls through the balancing devices of the back-up rolls.

The necessary and unavoidable play between the horizontal slots and the stop projections engaging in the horizontal slots resulting from the guidance between the pressure contact surfaces of the slots and the pressure receiving surfaces of the stop projections impairs an accurate adjustment of the bending forces particularly when very small bending forces are to be applied and also when the direction of the bending forces to be applied is reversed (zero pass).

SUMMARY OF THE INVENTION

Therefore, it is the primary object of the present invention to eliminate the above-mentioned disadvantages and to make it possible that the bending jaws interact with the chocks practically without play.

In accordance with the present invention, each bending jaw includes a pair of partial bending jaws which can be moved independently of each other and in opposite directions, wherein the pressure contact surfaces of each partial bending jaw corresponds to one or the other bending direction.

Each pair of partial bending jaws, which are drivable independently of each other and in opposite directions, form recesses with two pressure contact surfaces which are displaceable relative to each other under pressure and which, therefore, make it possible to grasp the pressure receiving surfaces of the stop projections of the respective chocks from both sides in the manner of tongs with counter-pressure and to apply the bending forces on the chocks without play even when the direction of these forces is reversed.

The invention can be utilized in all embodiments of two-high roll stands and cluster roll stands as well as in roll stands having axially displaceable rolls.

In accordance with another feature of the present invention, one of the partial bending jaws may have a cube-shaped or parallelepiped-shaped housing which is guided with plane contact sliding surfaces between counter-contact sliding surfaces of the housing of the other partial bending jaw.

The housing of the other partial bending jaw may be composed of two spaced-apart housing portions which guide the housing of the one partial bending jaw therebetween and are connected to each other through a cross member.

In addition, the piston-cylinder units driving corresponding partial bending jaws for the upper roll and the lower roll of the pair of rolls to be bent may be composed of a piston provided in the one partial bending jaw and connecting rods connected to the other partial bending jaw.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there is illustrated and described a preferred embodiment of the invention.

DETAILED DESCRIPTION OF THE PREFERRED EMBODIMENT

Figure 1:
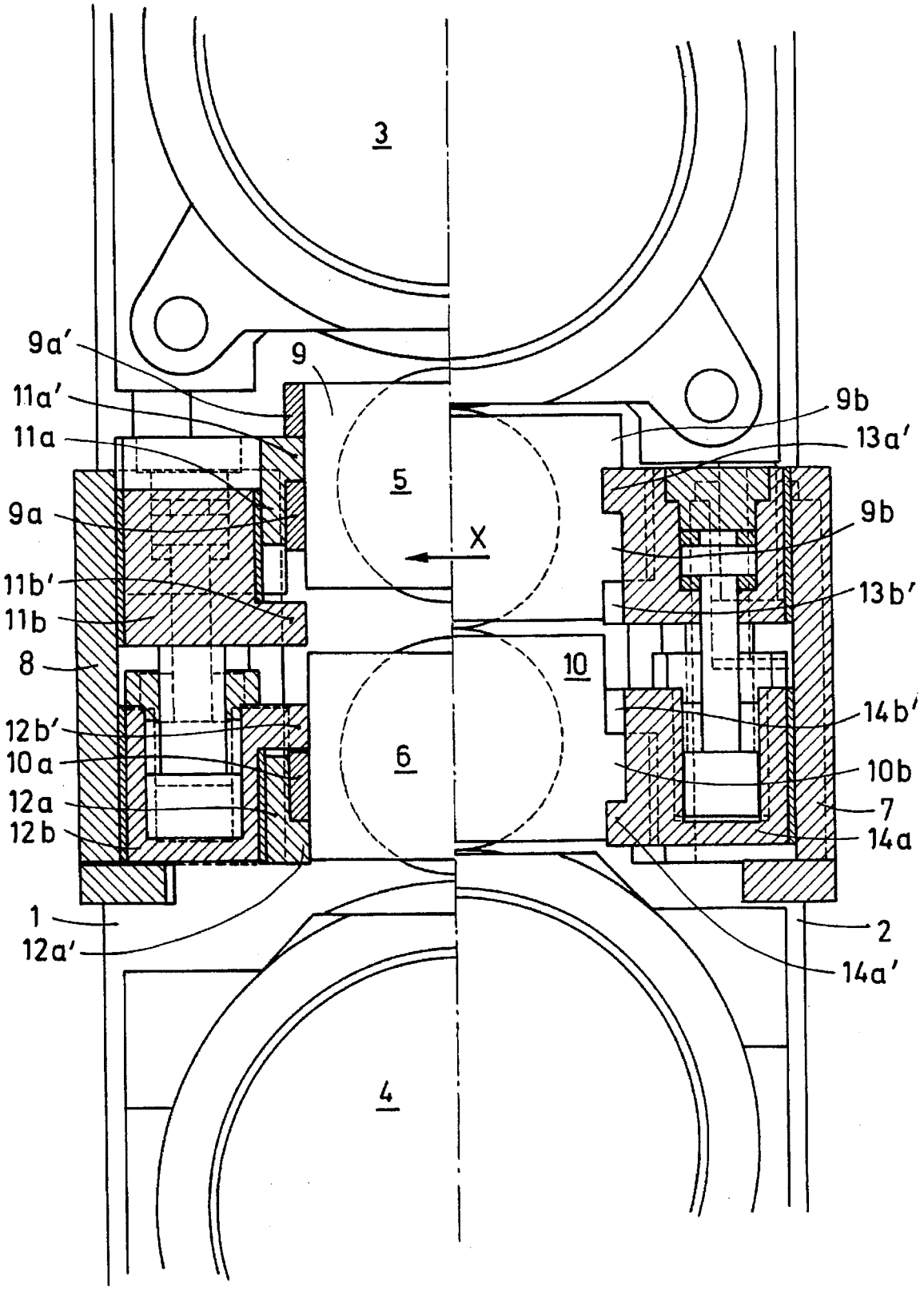
FIG. 1 is a schematic side view of a cluster roll stand, wherein the bending blocks are shown in cross section.

As illustrated in FIG. 1 of the drawing, bending blocks 7 and 8 are arranged in the windowed housing posts 1 and 2 of the roll stand on both sides of the pair of work rolls 5, 6. Back-up rolls 3 and 4 act on the work rolls 5, 6. The bending blocks 7 and 8 are rigidly connected to the housing posts 1 and 2.

As also shown in FIGS. 2, 3, 4 and 5, pairs of partial bending jaws 11*a*, 11*b*; 12*a*, 12*b* and 13*a*, 13*b*; 14*a*, 14*b* are vertically guided and arranged vertically above each other in the bending blocks 7 and 8, respectively.

Figure 4:
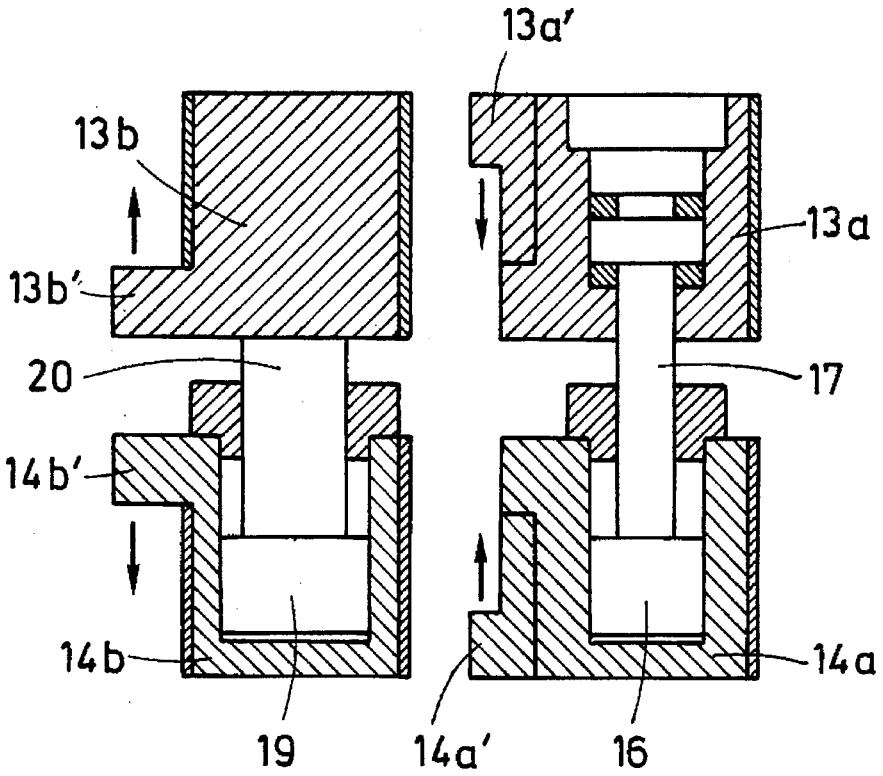
FIGS. 4 and 5 are partial sectional views of the bending jaws according to the present invention.
Figure 5:
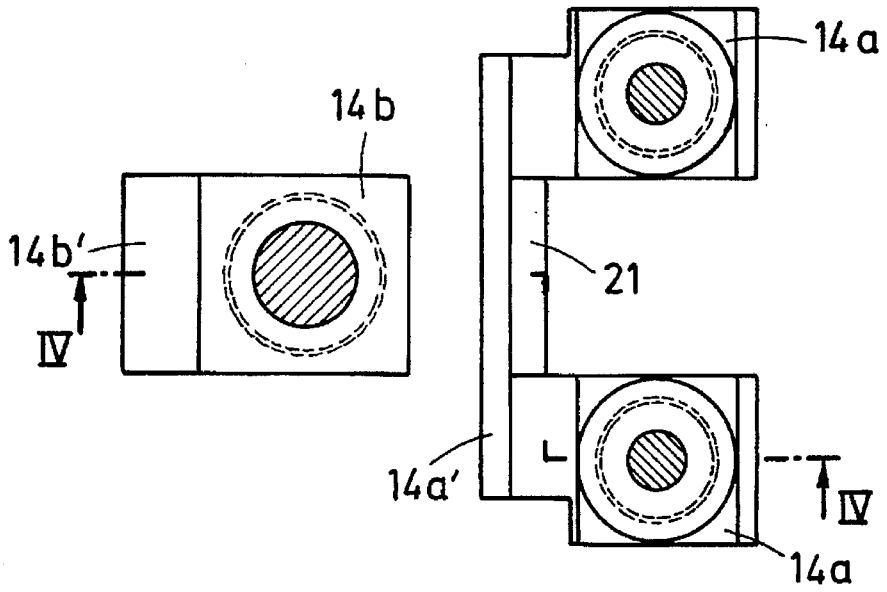

As can be seen particularly in FIGS. 4 and 5, the partial bending jaws 13*a*, 13*b* of a pair of partial bending jaws for the upper chock 9 are coupled to the partial bending jaws 14*a*, 14*b* arranged therebelow and provided for the chock 10 and form cylinder housings of piston-cylinder units whose pistons 16 and 19, respectively, are coupled to each other by common connecting rods 17 and 20, as particularly shown in FIG. 4.

Figure 3:
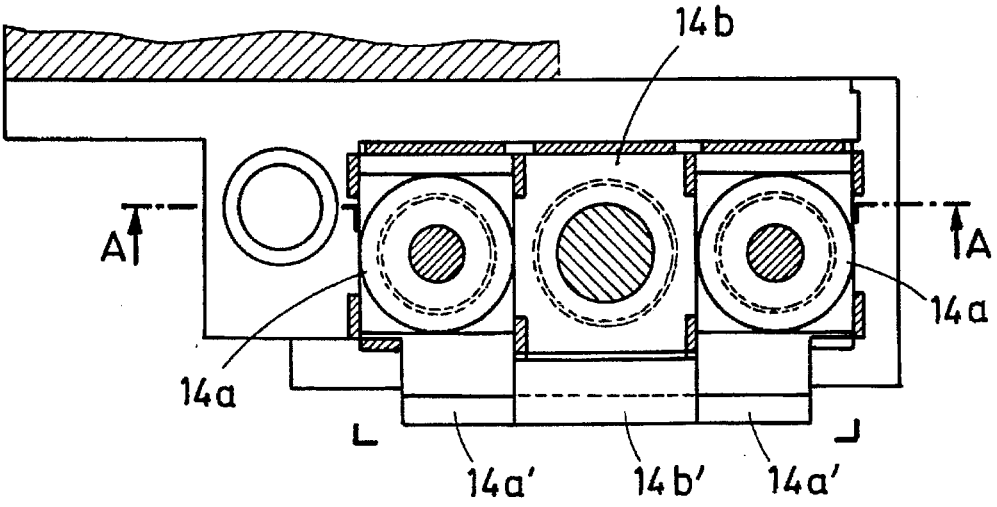
FIG. 3 is a sectional view taken along sectional line B—B of FIG. 2.

In the illustrated embodiment, the housings of the partial bending jaws 13*a*, 13*b* are cube-shaped, as shown in FIG. 5. The housing of the partial bending jaw 13*a* is composed of two spaced-apart housings, wherein the housing of the other partial bending jaw 13*b* is slidably guided between the two housings of the partial bending jaw 13*a*, as shown in FIG. 3. The two housings of the partial bending jaw 13*a* may be integrally connected to each other through a cross member 21.

As shown in FIG. 1, stop shoulders 11*a*', 11*b*'; 12*a*', 12*b*'; 13*a*', 13*b*'; 14*a*', 14*b*' which face the chocks 5, 6 are arranged on the respective partial bending jaws. The stop shoulders have pressure contact surfaces which are capable of acting on the pressure receiving surfaces of stop projections 9*a*, 9*b*; 10*a*, 10*b* arranged on the chocks 9 and 10, respectively, when the respective partial bending jaws 11*a*, 11*b*; 12*a*, 12*b*; 13*a*, 13*b*; 14*a*, 14*b* are moved toward each other by actuating the pistons 16 and 19, respectively.

As is apparent from the illustration of FIG. 1 in connection with FIG. 4, the stop shoulder 13*a'* of the partial bending jaw 13*a* and the stop shoulder 13*b'* of the partial bending jaw 13*b* move toward each other in the directions of the arrows shown in FIG. 4 and grasp the corresponding stop projection 9*b* of the chock 9 between each other in the manner of tongs. As a result, by an appropriate hydraulic control of the pistons 16 and 19, the desired pressure can now be applied without play from above or from below on the stop projection 9*b* and, thus, on the chock 9. The remaining stop projections 9*a*, 10*a* and 10*b* can be grasped in the same manner.

The disassembly of the work rolls 5, 6 is carried out by pulling the work rolls 5, 6 out of separate guides and over the partial bending jaws, as is evident from FIG. 1. During the disassembly, the lower chock 10 slides with the stop projections 10*a* and 10*b* thereof on the stop shoulders 12*a'* and 14*a'*, and the upper chock 9 slides with additional disassembly projections 9*a'* and 9*b'* on the stop shoulders 11*a'* and 13*a'*. This configuration makes it possible that the guides for the disassembly of the upper work roll 5 do not cause an obstacle in the spaces in front of and behind the roll gap with respect to strip guidance, cooling units and spraying units. The work rolls 5, 6 can also be pulled out on the stop projections 9*a* and 9*b*.

Figure 2:
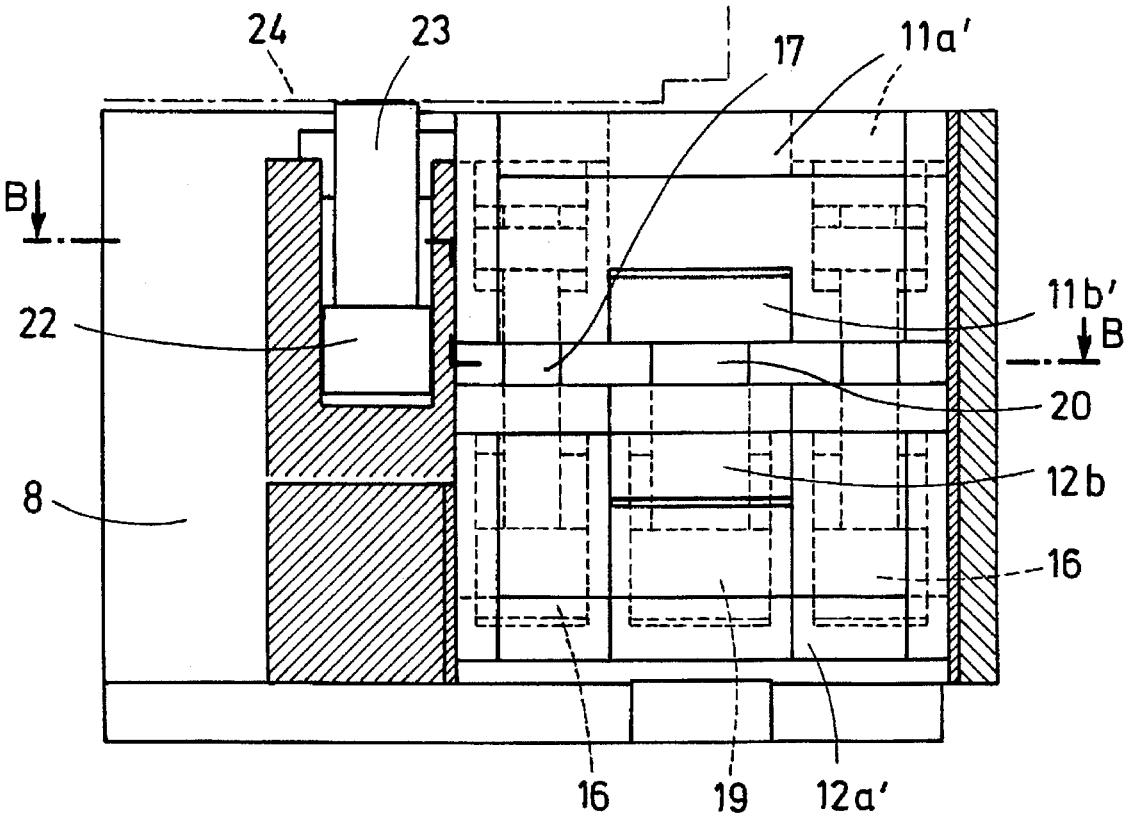
FIG. 2 is a sectional view taken along sectional line A—A of FIG. 3 taken in direction x of FIG. 1.

As is apparent from FIG. 2, the piston 22 with the piston rod 23 for balancing the chock 24 of the back-up roll is arranged in the housing of the bending block 8.

The invention is not limited by the embodiment described above which is presented as an example only but can be modified in various ways within the scope of protection defined by the appended patent claims.

I claim:

1. A bending block for bending a pair of rolls of a cluster roll stand, the cluster roll stand including chocks of the pair of rolls to be bent, each chock having sides, the bending block being rigidly connected on the sides of the chocks to one of windowed housing posts of roll housings and to units for a horizontal stabilization of the rolls, the bending block comprising bending jaws for bending the rolls in a first bending direction and in a second bending direction opposite the first bending direction, and piston-cylinder units for moving the bending jaws in the first and second bending directions, each chock or unit having a first pressure receiving surface for the first bending direction and a second pressure receiving surface for the second bending direction, the bending jaws each comprising first and second partial bending jaws and additional piston-cylinder units for moving the first and second partial bending jaws independently of each other in opposite directions, each partial bending jaw having a pressure contact surface, wherein the pressure contact surface of the first partial bending jaw is configured to act on the first pressure receiving surface and the pressure contact surface of the second partial bending jaw is configured to act on the second pressure receiving surface, wherein the first partial bending jaw comprises a cube-shaped or parallelepiped-shaped housing with plane contact sliding surfaces and the second partial bending jaw comprises a housing with counter-contact sliding surfaces, and wherein the plane contact sliding surfaces are guided between the counter-contact sliding surfaces.

2. The bending block according to claim 1, wherein the housing of the second partial bending jaw comprises two spaced-apart housing portions guiding the housing of the first partial bending jaw therebetween, and wherein the two spaced-apart housing portions are connected to each other through a cross member.

3. The bending block according to claim 1, wherein piston-cylinder units for moving corresponding partial bending jaws for an upper roll and a lower roll of the pair of rolls to be bent each comprise a piston mounted in one of the corresponding partial bending jaws and connecting rods connected to another of the corresponding partial bending jaws.

* * * * *